US011892173B2

(12) United States Patent
Singh

(10) Patent No.: US 11,892,173 B2
(45) Date of Patent: Feb. 6, 2024

(54) INTELLIGENT GAS COOKTOP BURNER

(71) Applicant: Rupendra Singh, Itasca, IL (US)

(72) Inventor: Rupendra Singh, Itasca, IL (US)

(73) Assignee: Robertshaw Controls Company, I tasca, IL (US)

( * ) Notice: Subject to any disclaimer, the term of this patent is extended or adjusted under 35 U.S.C. 154(b) by 73 days.

(21) Appl. No.: 17/834,029

(22) Filed: Jun. 7, 2022

(65) Prior Publication Data

US 2023/0051734 A1 Feb. 16, 2023

Related U.S. Application Data

(60) Provisional application No. 63/232,281, filed on Aug. 12, 2021.

(51) Int. Cl.
*F24C 3/12* (2006.01)
*F23N 1/00* (2006.01)

(52) U.S. Cl.
CPC ..... *F24C 3/126* (2013.01); *F23N 1/007* (2013.01); *F24C 3/124* (2013.01); *F23N 2229/22* (2020.01); *F23N 2235/16* (2020.01); *F23N 2235/24* (2020.01)

(58) Field of Classification Search
CPC ..... F24C 3/124; F24C 3/126; F23N 1/007
USPC ..... 126/39 E, 39 R; 431/13
See application file for complete search history.

(56) References Cited

U.S. PATENT DOCUMENTS

2008/0138750 A1* 6/2008 Kim ..... F23N 5/242 431/12
2020/0408413 A1* 12/2020 Billman ..... F24C 3/008
2021/0404666 A1* 12/2021 Cadima ..... F24C 3/008

* cited by examiner

*Primary Examiner* — Vivek K Shirsat
(74) *Attorney, Agent, or Firm* — Miller & Martin PLLC; Stephen J. Stark

(57) ABSTRACT

An intelligent cooktop has at least a first, if not multiple burners in proximity to at least a first sensor, respectively, wherein the first sensor provides an input to a processor which evaluates a burner performance characteristic selected from the group of least one of flame level, temperature rise, time lag, and temperature level using the first sensor compared to an anticipated performance characteristic of the first burner based on the valve position; and then provides a burner performance output to a user identifying a condition of the first burner.

15 Claims, 3 Drawing Sheets

INTELLIGENT BURNER SYSTEM

INTELLIGENT GAS COOKTOP BURNER

CLAIM OF PRIORITY

This application claims the benefit of U.S. Provisional Patent Application No. 63/232,281, which is incorporated herein by reference in its entirety.

FIELD OF THE INVENTION

The present invention relates to a gas burners, such as those used on gas cooktops, having temperature sensors and associated electronics so as to provide at least warnings when the burner is not functioning optimally.

BACKGROUND OF THE INVENTION

Gas burners are used in many cooking systems. In fact, the gas burners may be the most essential parts of many cooking systems.

However, there are instances when specific burners are not providing the desired flame heating due to various factors such as extended use, blockage, leaking or other factors. In such situations, customers are not able to get the desired performance of the burners.

Even if the product were to be electronically controlled, electronic controls would merely provide a signal directly related to a specified amount of gas flow to a burner at a particular time. Without feedback, it is not possible to detect the performance of any specific individual burner.

The applicant is unaware of any sensors or feedback loops utilized with gas cooktop burners to evaluate the efficiency or performance of a specific burner as compared to an expected level of sufficiency or performance.

SUMMARY OF THE INVENTION

It is an object of many embodiments of the present invention to provide an improved intelligent gas cooktop burner.

It is another object of many embodiments of the present invention to provide an improved gas cooktop burner having feedback.

It is another object of many embodiments of the present invention to provide a temperature sensor in combination with a gas cooktop burner and a processor whereby the processor evaluates at least one of the performance and/or efficiency of the burner based on expected parameters.

It is another object of many embodiments of the present invention to provide an improved gas cooktop burner.

Accordingly, in accordance with many embodiments of the present invention, an improved gas cooktop burner is provided. Specifically, by adding at least one sensor proximate to a burner, such as a cooktop burner of a range or stove cooktop, and a processor, the temperature rise of a particular burner can be measured through the temperature sensor which may be located on a burner. Temperature rise, time lag or temperature levels can be compared to the ideal or designed values as programmed or received inside the electronics or processor. If the temperature rise, lag or level is within an acceptable band or at an acceptable level, then the burner may be known to be giving at least approximate to 100% efficiency or satisfactory efficiency. However, if a significant difference exists between the performance of the burner and the anticipated performance of the burner, then the processor may provide a signal to either be displayed or heard so as to notify the user that the burner may need to be repaired, cleaned, replaced or have other maintenance activity performed. For an electronically controlled cooktop having electronic control board, a decrease in efficiency or decrease in performance may be displayed on the display for the user to be advised of the condition.

Not only can the temperature be monitored via feedback, but also temperature rise may be monitored via feedback. The change in temperature (temperature rise) can be compared to anticipated temperature change within an expected band (and/or time) in an effort to identify whether the burner is at optimum or sub-optimum efficiency and/or whether the sub-optimal efficiency performance is sufficient to give rise to a notice to a user so as to perform maintenance on the burner or associated system.

BRIEF DESCRIPTION OF THE DRAWINGS

The particular features and advantages of the inventions with other objects will become apparent from the following description taken in connection with the accompanying drawings in which.

DETAILED DESCRIPTION OF THE PREFERRED EMBODIMENT

Figure 1:
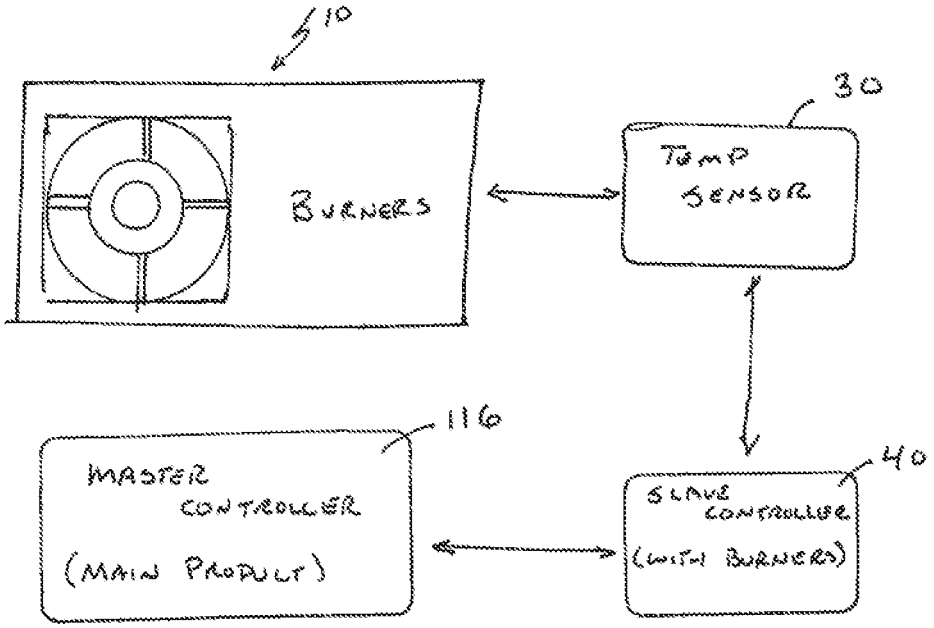
FIG. 1 is a block diagram of a cooktop with burner in accordance with the presently preferred embodiment of the present invention.
Figure 2:
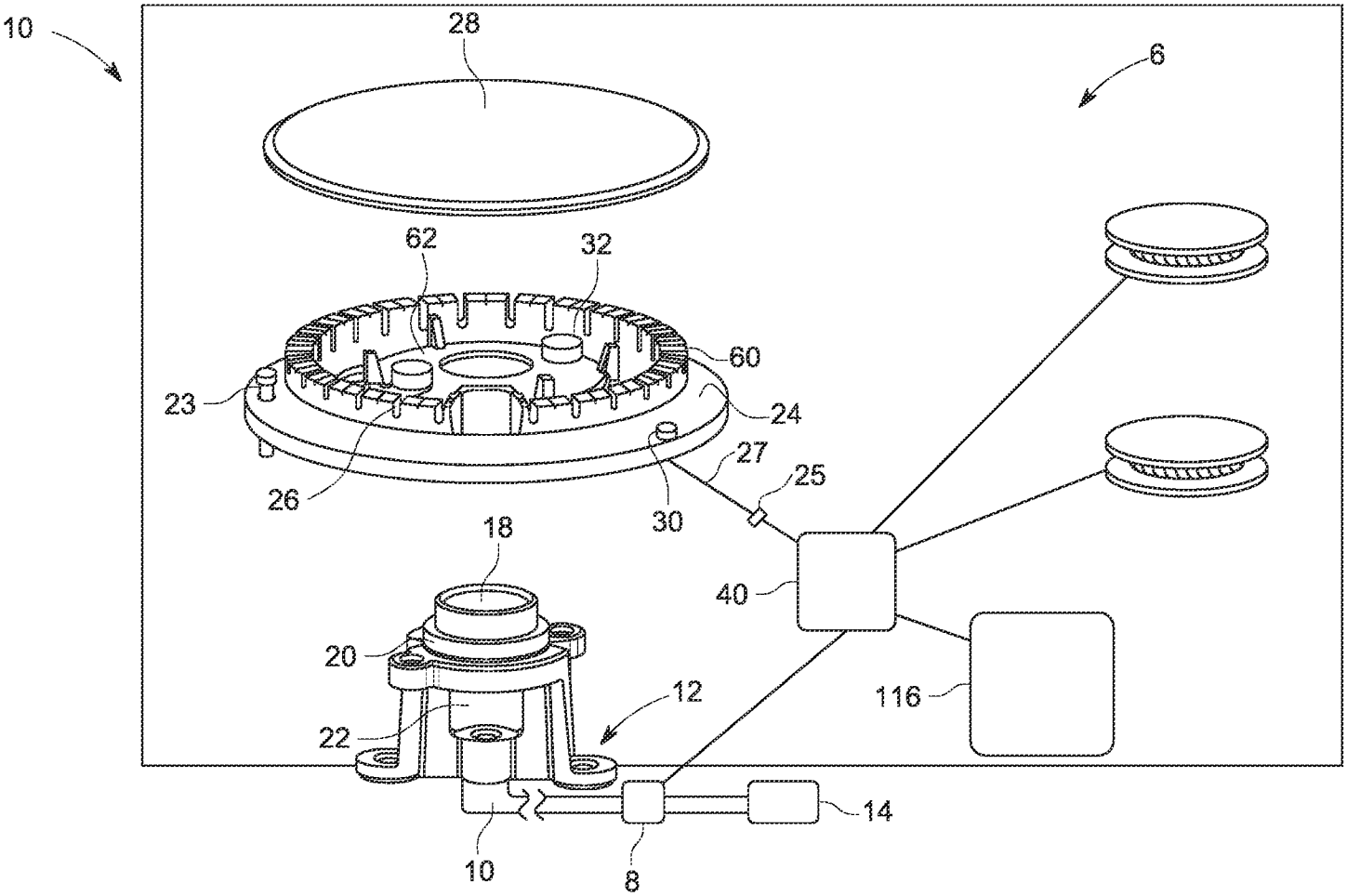
FIG. 2 is a perspective exploded and diagramic figure of a burner of FIG. 1.
Figure 3:
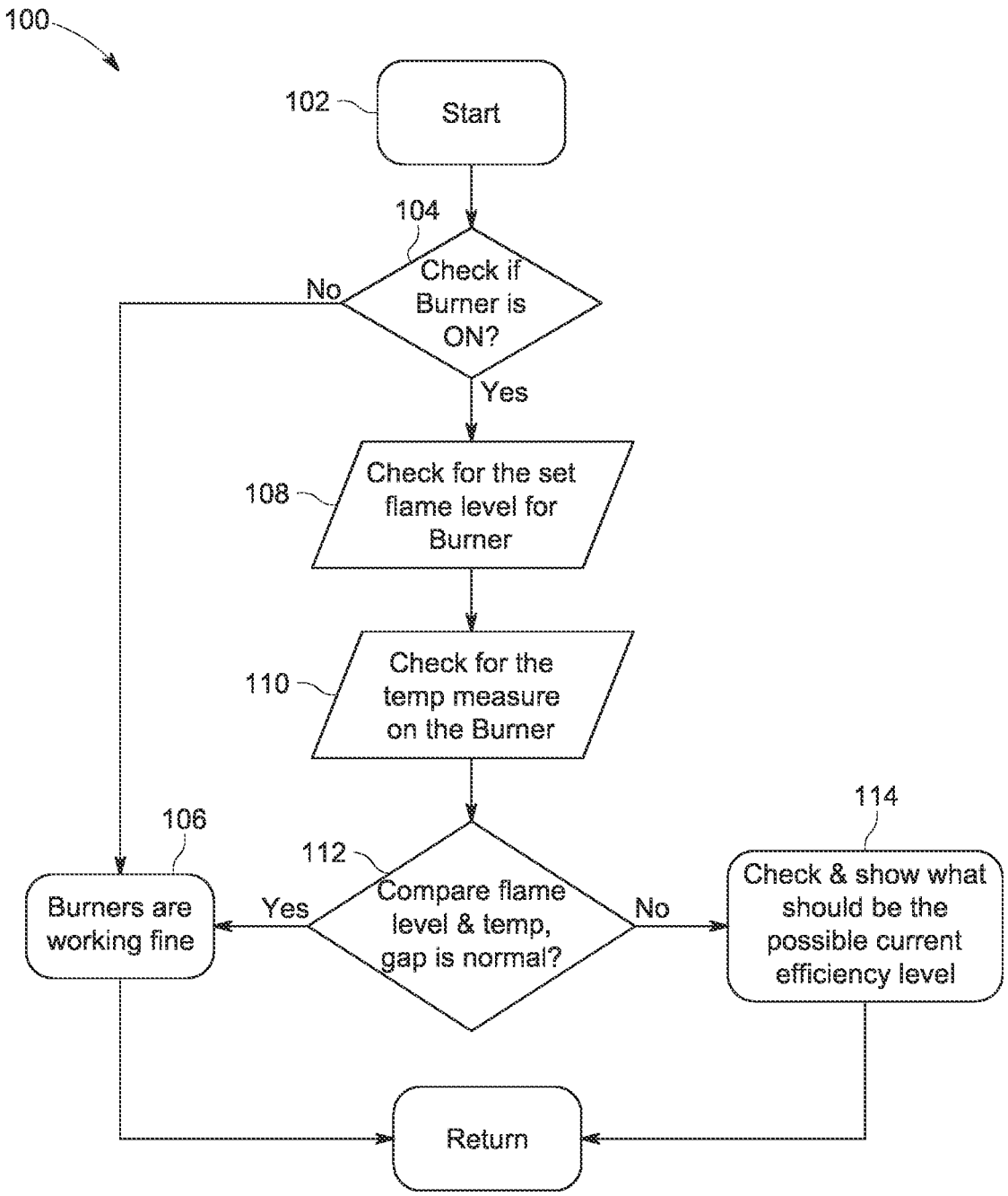
FIG. 3 is a flow chart showing operation of the burner of FIG. 1.

FIGS. 1 and 2 show a diagramical representation of a cooktop with a burner 10 in accordance with a presently preferred embodiment of the present invention. A burner 10 is preferably used with a gas oven range or other cooking article 6. The burner 10 may be one of a plurality of burners in the cooking article 6. The burner has a burner supply system 12 which communicates a gas source 14, such as but not limited to natural gas as illustrated, propane from a tank, or other source. Piping 16, illustrated as an aluminum tube, is shown directing from gas source 14 to an inlet 18, which may be formed as a portion of housing 20. Housing 20 may also allow for mixing with combustion air such as at gap 22. Other components as are known in the art could be positioned between the gas source 14 and inlet 18. Other burners 10 may have different gas supply system 12 of various constructions which direct at least some gaseous fuel into the burner 10.

The gas supply system 12 directs fuel to the burner head 24. The burner head 24 is typically aluminum or brass. Other materials could be used with other embodiments. The burner head 24 is sometimes referred to as a flame spreader. It is normally cast and/or machined and provides flame slots 26 through which a lit burner 10 is normally identified. Other orifices, slots or other features may be provided along a perimeter of burner head 24 as are known in the art which can provide for a variety of features.

On top of the burner head 24, a burner cap 28 is normally provided. The burner cap 28 is normally set on top of the burner head 24 and retained in position by gravity and, possibly a mating geometry. Burner caps 28 are normally made of metal and often coated with a porcelain enamel.

In a preferred embodiment, at least one if not two or more sensor(s) 30, 32 are provided with the burner 10 such as on the burner head 24 either internal to the flame slots 26 such as sensor 32 or external to the flame slots 26 such as sensor 30 on base 21 or other location. While there may be one of the two sensor(s) 30 or 32, there certainly could be more than one sensor 30, 32 for each burner 10. Each of the sensor(s) 30 and/or 32 (or others) preferably provides a signal to electronics illustrated as processor 40 such as through a connection 25 which may be similar or dissimilar to the connectors utilized for ignitors such as ignitor 23 which may be utilized to ignite the fuel/gas mixture emanating from the flame slots 26. It may be that the sensor(s) 30, 32 have a lead such as wire 27 extending therefrom which can connect to the processor 40 either with or without a connection 25. The processor 40 also preferably receives an input such as the one illustrated from valve 8 which identifies the position of the valve through the processor 40. The processor may then calculate, or have an anticipated temperature rise, time lag, and/or temperature level to be expected at the burner 10 based on the position of the valve 8 or its change in position so that the input received from the sensor(s) 30, 32 can be compared thereto.

The burner 10 performance can be calculated or evaluated based on acceptable valves and/or ranges. If out of range or outside of a level, an alarm condition may exist. Display 116 may display the alarm condition. An audible alarm may be provided whether as a voice or as a more traditional alarm sound at processor 40 or other location. Additionally, the display 116 could be a display of a cooktop or cooking appliance 6 as one that could report the condition of the burner(s) 10, electronically control valves such as valve 8 and/or display their position, and/or display a status of the various burners such as burner 10 and/or others which may be similar or dissimilar in construction or operation as burner 10.

If a condition of a burner 10 is out of a pre-determined range such as the temperature rise or time lag sensed by the sensor(s) 30, 32 does not meet the anticipated temperature rise based on the change from low to high and/or other settings when the valve 8 is turned from low to high, etc. by the process at step 40, then alarm conditions can be identified by the processor 40. A time lag or gap may be too long for the temperature at sensor(s) 30, 32 to reach a particular temperature.

FIG. 2 shows a flow chart 100 of the presently preferred embodiment and the method of using the burner 10 shown on FIG. 1. Specifically, at step 102 the process starts. At step 104 an analysis is made as whether or not the burner 10 is on. If the burner 10 is not on, then the burner 10 is presumed to be working fine at step 106. If the burner 10 is on, then a check of the burner 10 performance can be provided at step 108 so as to check for a set flame level for the burner 10 which can be obtained such as from the valve 8.

Proceeding to step 110 a check is made to ascertain the temperature measured on the burner 110 such as from one or more of the sensor(s) 30, 32. The flame level, temperature, and/or gap time may be analyzed at step 112 to determine if the burner 10 function is normal or satisfactory, and if it is normal (or satisfactory) the burner 10 is working satisfactorily at step 106. If the function of the burner 10 is not normal, a determination may be made by the processor 40 as to what the possible current efficiency level is at step 114 and then displayed such as on display 116. Display 116 may be a display of a control system of a cooktop, cooking article 6, or other display 116. While the output of the processor 40 may be displayed as shown, other outputs and/or displays 116 could include signal alarms, voice alarms and/or other effects. The display 116 may display the apparent efficiency of the burner 10. The display 116 and processor 40 could also be utilized to evaluate multiple burners such as shown in FIG. 1 and/or others.

In addition to evaluating a temperature level being in a normal range, the processor 40 could have a micro-controller to control external devices, control and/or receive inputs such as from external devices like temperature sensor(s) 30,32 or other sensors/devices which could be connected to the burner 10 and/or processor 40 to measure temperature rise on the burner body 24 and/or other location such as proximate to the flames emitted from the flame slots 26. Preferably the processor 40 is not in physical contact with the burner body or burner head 24 but is instead spaced a sufficient distance so as to not be harmed by the heat given off of the burner 10. The electronic controller or processor 40 currently has the logics or logistics to and possibly and control features as well. A recording feature of data to and/or from the processor 40 may also be provided to record the signals. When the burners 10 are on, the controller or processor 40 may learn from the valve 8 and/or an electronic control display 116 the flame level set to compare with the temperature sensor(s) 30,32 to start monitoring the temperature rise, time lag or gap, and the desired temperature level.

If a temperature rise is within a predetermined temperature band and/or time lag for a specified flame level (or level changes), then a signal can be provided from the processor 40 to the display or otherwise that the burner 10 is operating satisfactorily. If a temperature rise is not within the expected band or time lag, then it may be possible to report an error condition to the display 116 or otherwise. In fact, the calculated efficiency of the burner 10 may be reported on the display 116. The controller 40 and/or display 116 can give the warnings/notifications to the customer or user so as to reach out to customer support and/or identify a potential problem associated with a lack of desired performance of the burner 10. If a time gap between the expected rise and the actual rise exceeds a predetermined valve then it may be that the processor 40 and/or a controller or processor 40 associated with the valve 8 or display 116 may attempt to shut off the flow from the gas supply 14. This may prevent a likelihood of gas leakage, choking, or other problems which could affect the performance of the burner 10 or otherwise create a dangerous situation.

By adding the sensor(s) 30,32 to the burner 10, the burner 10 has an ability to measure the temperature rise of the burners 10 with the sensor 32 potentially being placed inside of the burner 10. or sensor 30 connected to the burner 10 such as on the base 21 of the burner head 24 or other appropriate location. Temperature rise, temperature levels and/or time lag can be evaluated by the processor 40 and compared to the desired temperature, temperature rise band, and/or time gap provided to the processor 40 if not present internal thereto, so that the processor 40 can determine if the burner 10 is operating satisfactory or not such as is shown in FIG. 2.

Furthermore, the processor 40 may evaluate the efficiency of the burner 10 at that particular point in time and report to the display 116 and/or identify whether or not the burner 10 is believed to need to be repaired, cleaned or replaced or have other maintenance performed. The burners 10 may have connectors such as connector 25 to connect to the processor 40 and/or leads 27 possibly in a similar manner as the ignitor 23 may be connected to the appropriate electronics or otherwise.

While electronic displays exist for ovens having controls, the applicant is unaware of any displays 116 being utilized with controllers 40 controlling and more importantly none receiving feedback from burners 10.

By receiving feedback in the form of temperature sensor data provided to a processor 40 related to the performance of the burner 10, the processor 40 can evaluate the performance of the burner 10 as compared to anticipated performance based on the gas flow intended to be provided to the burner 10 under a specific set of situations such as a specific setting of the gas valve 8 and if the performance and/or efficiency of the burner 10 is within an acceptable range, then the burner 10 will be believed to be operating satisfactorily. If the burner 10 performance is outside of the desired range or level, then a potential issue exists which can be analyzed by the processor 40 and indicated to the user in one of various ways such as on the display 116 or otherwise as described herein as would be known to one of ordinary skill in the art, possibly to enact safety measures, possibly including securing gas flow from the supply 14 to the burner 10.

The temperature sensors 30,32 might be configured to sense at least one of radiated and conductive heat which may be direct or indirect evaluation of the heat generated by the burner 10 under specified operating conditions. Furthermore, depending on whether or not and what kind of cooking utensil is provided on the burner, the temperature received by the sensor(s) 30,32 may differ but still may be within a desired range as recognized by the processor 40. This could apply to temperature rise, time log, and/or temperature setting and/or other factors as evaluated by the processor 40.

At least one of controller, or processor 40, and display 116 which may be a touch pad display/controller for at least some embodiments may also provide DSI (Direct Spark System)/FFD (Flame Failure Device). The temperature sensor(s) 30,32 may be utilized with such systems and possibly processor 40 so as to identify a situation when there is no change in temperature (or not within a temperature band or at a specified value) but the burners 10 are "ON" as recognized by the position of the valve 8, or by other means. Thus, by including the feedback with the sensor(s) 30,32, another safety feature can be provided related to flame failure. Multiple processors 40 or a single processor 40 can be provided with a cooking appliance 6 and possibly be provided with display 116.

For cooking appliances 6, which are connected to the Internet, the cloud, and/or to other "smart" devices, an automatic ticket or other notification may be sent by the cooking appliance 6 remotely, and preferably wirelessly, such as from controller/display 116 or other location to advise of a need to clean the burner(s) 10 which may be then sent either directly or indirectly (such as first through the manufacturer of the cooking appliance 6 to the user, such as to an email address, a cell phone number (either call or text), etc., to an app in use by the user, etc.

Numerous alterations of the structure herein disclosed will present themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having set forth the nature of the invention, what is claimed herein is:

1. A cooking appliance comprising:

a first burner of a cooktop having a burner head, flame slots extending through the burner head, and a burner cap on top of the burner head;

a first sensor located proximate to one of the flame slots;

a processor receiving a first electronic input from the first sensor;

a first valve providing a valve input to the processor, the valve input is related to a valve position of the first valve, said first valve located intermediate the first burner and a gas supply selected from propane and natural gas; and a second sensor proximate to the flame slots of the first burner, said second sensor directing a second electronic input to the processor;

wherein the processor evaluates a burner performance characteristic selected from the group of least one of flame level, temperature rise, time lag, and temperature level using the first electronic input compared to an anticipated performance characteristic of the first burner based on the valve position of the first valve; and then provides a first burner performance output to a user identifying a condition of the first burner; and wherein the first sensor is located internal to the flame slots.

2. A cooking appliance comprising:

a first burner of a cooktop having a burner head, flame slots extending through the burner head, and a burner cap on top of the burner head;

a first sensor located proximate to one of the flame slots;

a processor receiving a first electronic input from the first sensor;

a first valve providing a valve input to the processor, the valve input is related to a valve position of the first valve, said first valve located intermediate the first burner and a gas supply selected from propane and natural gas; and wherein the processor evaluates a burner performance characteristic selected from the group of least one of flame level, temperature rise, time lag, and temperature level using the first electronic input compared to an anticipated performance characteristic of the first burner based on the valve position of the first valve; and then provides a first burner performance output to a user identifying a condition of the first burner; and a recorder recording the first burner performance output.

3. The cooking appliance of claim 2 wherein if the first burner performance output is out of range, the processor directs one of an error and an alarm to the user.

4. The cooking appliance of claim 3 wherein the alarm is one of an audible and a displayed alarm.

5. The cooking appliance of claim 4 further comprising a touch screen display and the alarm is displayed on the touch screen.

6. The cooking appliance of claim 4 a first burner of a cooktop having a burner head, flame slots extending through the burner head, and a burner cap on top of the burner head;

a touch screen display;

a first sensor located proximate to one of the flame slots;

a processor receiving a first electronic input from the first sensor;

a first valve providing a valve input to the processor, the valve input is related to a valve position of the first valve, said first valve located intermediate the first burner and a gas supply selected from propane and natural gas; and wherein the processor evaluates a burner performance characteristic selected from the group of least one of flame level, temperature rise, time lag, and temperature level using the first electronic input compared to an anticipated performance characteristic of the first burner based on the valve position of the first valve; and then provides a first burner performance output to a user identifying a condition of the first burner, and if the first burner performance output is out of range, the processor directs one of an error and an alarm selected from the group of an audible alarm and a displayed alarm on the touch screen display to the user, with the processor directing the user to perform one of (a) repair the first burner, (b) replace the first burner and (c) clean the first burner.

7. The cooking appliance of claim 2 wherein the anticipated burner performance characteristic is learned by the processor over a period of time.

8. The cooking appliance of claim 2 further comprising a display and the first burner performance output is displayed on the display.

9. A cooking appliance comprising:

a first burner of a cooktop having a burner head, flame slots extending through the burner head, and a burner cap on top of the burner head;

a first sensor located proximate to one of the flame slots;

a display;

a processor receiving a first electronic input from the first sensor;

a first valve providing a valve input to the processor, the valve input is related to a valve position of the first valve, said first valve located intermediate the first burner and a gas supply selected from propane and natural gas; and wherein the process evaluates a burner performance characteristic selected from the group of least one of flame level, temperature rise, time lag, and temperature level using the first eletronic input compared to an anticipated performance characteristic of the first burner based on the valve position of the first valve; and then provides a first burner performance output to a user identifying a condition of the first burner, the first burner performance output is displayed on the display, and if the first burner performance output is within an anticipated range, the display indicates the first burner is performing satisfactory.

10. A cooking appliance comprising:

a first burner of a cooktop having a burner head, flame slots extending through the burner head, and a burner cap on top of the burner head;

a first sensor located proximate to one of the flame slots;

a display;

a processor receiving a first electronic input from the first sensor;

a first valve providing a valve input to the processor, the valve input is related to a valve position of the first valve, said first valve located intermediate the first burner and a gas supply selected from propane and natural gas; and wherein the processor evaluates a burner performance characteristic selected from the group of least one of flame level, temperature rise, time lag, and termperature level using the first eletronic input compared to an anticipated performance characteristic of the first burner based on the valve position of the first valve; and then provides a first burner performance output to a user identifying a condition of the first burner, the first burner performance output is display on the display, and the first burner performance output is displayed as an efficiency for the first burner.

11. A cooking appliance comprising:

a first burner of a cooktop having a burner head, flame slots extending through the burner head, and a burner cap on top of the burner head;

a first sensor located proximate to one of the flame slots;

a processor receiving a first electronic input form the first sensor;

a first valve providing a valve input to the processor, the valve input is related to a valve position of the first valve, said first valve located intermediate the first burner and a gas supply selected from propane and natural gas; and wherein the processor evaluates a burner performance characteristic selected from the group of least one of flame level, temperature rise, time lag, and temperature level using the first electronic input compared to an anticipated performance characteristic of the first burner based on the valve position of the first valve; and then provides a first burner performance output to a user identifying a condition of the first burner, and if the first burner performance output is out of range, the processor initiates a signal to be communicated wireless to ultimately be received by a manufacturer of the cooking appliance.

12. A cooking appliance comprising:

a first burner of a cooktop having a burner head, flame slots extending through the burner head, and a burner cap on top of the burner head;

a first sensor located proximate to one of the flame slots;

a processor receiving a first electronic input from the first sensor;

a first valve providing a valve input to the processor, the valve input is related to a valve position of the first valve, said first valve located intermediate the first burner and a gas supply selected from propane and natural gas; and wherein the processor evaluates a burner performance characteristic selected from the group of least one flame level, temperature rise, time lag, and temperature level using the first electronic input compared to an anticipated performance characteristic of the first burner based on the valve position of the first valve; and then provides a first burner performance output to a user identifying a condition of the first burner, and if the first burner performance output is out of range, the processor directs one of an error and an alarm to the user and sends a signal to shut off the valve.

13. The cooking appliance of claim 12 further comprising a flame failure device connected to the first burner.

14. The cooking appliance of claim 12 further comprising a direct spark ignition system connected to the first burner.

15. The cooking appliance of claim 12 further comprising a second burner of the cooktop having a burner head, flame slots extending through the burner head, and a burner cap on top of the burner head;

a third sensor located proximate to one of the flame slots;

the processor receiving a third electronic input from the third sensor;

a second valve providing a second valve input to the processor, the second valve input is related to a valve position of the second valve, said second valve located intermediate the second burner and the gas supply; and wherein the processor evaluates the burner performance characteristic using the third electronic input compared to an anticipated performance characteristic of the second burner based on the second valve position; and then provides a second burner performance output to a user identifying a condition of the second burner.

* * * * *